US010875296B2

(12) United States Patent
Gardner et al.

(10) Patent No.: US 10,875,296 B2
(45) Date of Patent: Dec. 29, 2020

(54) NOZZLE SENSOR PROTECTION

(71) Applicant: HEWLETT-PACKARD DEVELOPMENT COMPANY, L.P., Spring, TX (US)

(72) Inventors: James Michael Gardner, Corvallis, OR (US); Daryl E Anderson, Corvallis, OR (US); Eric Martin, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/462,311

(22) PCT Filed: Feb. 27, 2017

(86) PCT No.: PCT/US2017/019782
§ 371 (c)(1),
(2) Date: May 20, 2019

(87) PCT Pub. No.: WO2018/156172
PCT Pub. Date: Aug. 30, 2018

(65) Prior Publication Data

US 2019/0366708 A1 Dec. 5, 2019

(51) Int. Cl.
*B41J 2/045* (2006.01)
*B41J 2/14* (2006.01)

(52) U.S. Cl.
CPC ..... *B41J 2/04541* (2013.01); *B41J 2/0458* (2013.01); *B41J 2/14153* (2013.01)

(58) Field of Classification Search
CPC .. B41J 2/0458; B41J 2/14153; B41J 2/04541; B41J 2/04501
See application file for complete search history.

(56) References Cited

U.S. PATENT DOCUMENTS

| | | | |
|---|---|---|---|
| 5,608,442 | A | 3/1997 | Bennefeld et al. |
| 5,714,900 | A | 2/1998 | Ehlers |
| 6,286,922 | B1 | 9/2001 | Kondou |
| 6,361,150 | B1 | 3/2002 | Schulte et al. |
| 6,945,622 | B2 | 9/2005 | Sakurai |
| 7,201,461 | B2 | 4/2007 | Kim et al. |
| 7,361,966 | B2 | 4/2008 | Young et al. |

FOREIGN PATENT DOCUMENTS

WO WO-2017027020 2/2017

OTHER PUBLICATIONS

Banakar, P et al., Protecting Your Low Voltage Electronic Devices From Electrical Overstress, Nov. 2, 2013, < http://www.embedded.com/design/prototyping-and-development/4423709/Protecting-your-low-voltage-electronic-devices-from-electrical-overstress >.

*Primary Examiner* — Jannelle M Lebron
(74) *Attorney, Agent, or Firm* — Dierker & Kavanaugh PC

(57) ABSTRACT

A fluid ejection die that may include a drive bubble device, a sensor and a sensor control logic. The drive bubble device can include a fluid ejector. Furthermore, the sensor can be operatively connected to the drive bubble device and the sensor control logic can be operatively connected to the sensor. Moreover, the sensor control logic can include a protective circuitry that can be operatively connected between the sensor control logic and the drive bubble device. The protective circuitry can be configured to shunt excess portions of a signal transmitted from the sensor to protect a circuit path to a DBD control circuit.

15 Claims, 4 Drawing Sheets

NOZZLE SENSOR PROTECTION

BACKGROUND

Fluid ejection dies may be implemented in fluid ejection devices and/or fluid ejection systems to selectively eject/dispense fluid drops. Example fluid ejection dies may include nozzles, ejection chambers and fluid ejectors. In some examples, the fluid ejectors may eject fluid drops from an ejection chamber out of the nozzle.

BRIEF DESCRIPTION OF THE DRAWINGS

The disclosure herein is illustrated by way of example, and not by way of limitation, in the figures of the accompanying drawings in which like reference numerals refer to similar elements, and in which.

Figure 1A:
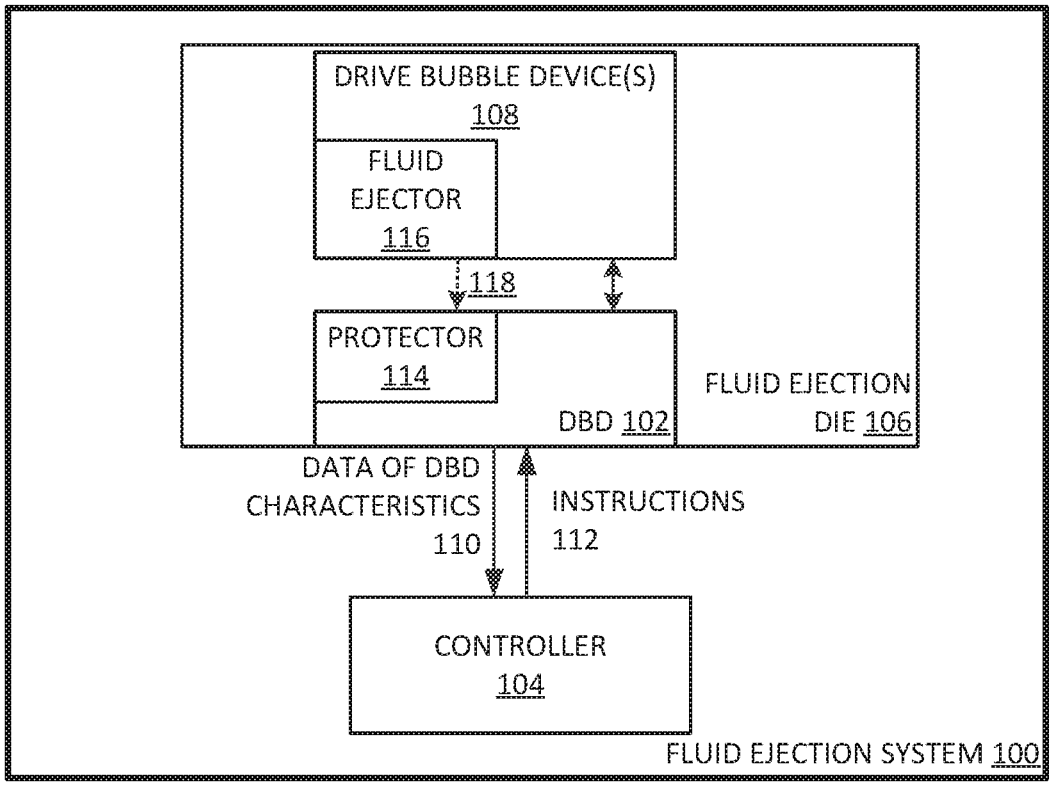
FIG. 1A illustrates an example fluid ejection system to evaluate a drive bubble device.

Throughout the drawings, identical reference numbers designate similar, but not necessarily identical elements. The figures are not necessarily to scale, and the size of some parts may be exaggerated to more clearly illustrate the example shown. Moreover the drawings provide examples and/or implementations consistent with the description. However, the description is not limited to the examples and/or implementations provided in the drawings.

DETAILED DESCRIPTION

Examples include a fluid ejection system that includes a protective circuit with a shunt path to extend from a circuit path of a DBD (drive bubble detect) sensing component. Shunt path 334 can include a diode connected to a low voltage power source in order to carry a portion of the signal, and to protect a circuit path to a nozzle sensor control logic.

Examples recognize that within fluid ejection systems, conditions may exist that damage or deteriorate important elements such as DBD circuitry. For example, fluid ejection systems often locate an electrically active DBD sensing component directly over a an electrical fluid ejector. Over time, like with any electronic device, the fluid ejector can fail, resulting in a short between the failed fluid ejector and the DBD sensing component. Under those conditions, if the insulating layer is damaged enough, the damage due to the short can spread to the DBD sensing component, to the sensor control logic, and can even cause total fluid ejection die failure. Among other benefits, examples are described that enable the fluid ejection system to include a protective circuit to protect a low voltage sensor control logic from shorts. In some examples, the sensor control logic can include DBD circuitry.

System Description

FIG. 1 illustrates an example fluid ejection system to evaluate a drive bubble device. As illustrated in FIG. 1 fluid ejection system 100 can include DBD 102, controller 104, fluid ejection die 106, and drive bubble device(s) 108. DBD 102 can be configured to implement processes and other logic to monitor drive bubble device(s) 108. Furthermore, DBD 102 can be configured to include protector 114.

Protector 114 can protect DBD 102 from a short 118, from fluid ejector 116 that has failed (e.g. from a manufacturing defect, or general usage wear and tear). In some examples, the circuitry of protector 114 can be added to circuit path 332 between a DBD sensing component and DBD 102. In some examples, DBD 102 may include sensor control logic and the sensor control logic may include DBD circuitry. In such examples, the DBD circuitry can include control components or circuitry. As such, protector 114 can protect the control components or circuitry of DBD 102.

Controller 104 can be configured to implement processes and other logic to manage operations of the fluid ejection system 100. For example, controller 104 can evaluate or determine the health and functionality of a fluid ejection die by controller 104 instructing DBD 102 to make assessments on drive bubble device(s) 108. Furthermore, while DBD 102 is making assessments on drive bubble device(s) 108, controller 104 can transmit instructions 112 to fluid ejection die 106 to concurrently implement servicing or pumping of other drive bubble device(s) 108. In some examples, controller 104 can communicate with fluid ejection die 106 to fire/eject fluid out of drive bubble device(s) 108. As herein described, any fluid, for example fluid, can be used can be fired out of drive bubble device(s) 108. In other examples, controller 104 can transmit instructions 112 to fluid ejection die 106 to implement servicing or pumping of drive bubble device(s) 108. In some examples, controller 104 can include one or more processors to implement the described operations of fluid ejection system 100.

Drive bubble device(s) 108 can include a nozzle, a fluid chamber and a fluid ejection component. In some examples, the fluid ejection component can include a heating source. Each drive bubble device can receive fluid from an fluid reservoir. In some examples, the fluid reservoir can be fluid feed holes or an array of fluid feed holes. In some examples, the fluid can be ink (e.g. latex ink, synthetic ink or other engineered fluidic inks).

Fluid ejection system 100 can fire fluid from the nozzle of drive bubble device(s) 108 by forming a bubble in the fluid chamber of drive bubble device(s) 108. In some examples, the fluid ejection component can include a heating source. In such examples, fluid ejection system 100 can form a bubble in the fluid chamber by heating the fluid in the fluid chamber with the heat source of drive bubble device(s) 108. The bubble can drive/eject the fluid out of the nozzle, once the bubble gets large enough. In some examples, controller 104 can transmit instructions 112 to fluid ejection die 106 to drive a signal (e.g. power from a power source or current from the power source) to the heating source in order to create a bubble in the fluid chamber (e.g. fluid chamber 202). Once the bubble in the fluid chamber gets big enough, the fluid in the fluid chamber can be fired/ejected out of the nozzles of drive bubble device(s) 108.

In some examples, the heating source can include a resistor (e.g. a thermal resistor) and a power source. In such examples, controller 104 can transmit instructions 112 to fluid ejection die 106 to drive a signal (e.g. power from a power source or current from the power source) to the resistor of the heating source. The longer the signal is applied to the resistor, the hotter the resistor becomes. As a result of the resistor emitting more heat, the hotter the fluid gets resulting in the formation of a bubble in the fluid chamber.

Fluid ejection system 100 can make assessments of drive bubble device(s) 108 by electrically monitoring drive bubble device(s) 108. Fluid ejection system 100 can electrically monitor drive bubble device(s) 108 with DBD 102 and a nozzle sensor or a DBD sensing component operatively communicating with drive bubble device(s) 108. DBD sensing component can be a conductive plate. In some examples DBD sensing component can be a tantalum plate.

In some examples, DBD 102 may electrically monitor the impedance of the fluid in drive bubble device(s) 108, during the formation and dissipation of the bubble in drive bubble device(s) 108. For instance, DBD 102 can be operatively connected to a DBD sensing component that itself is operatively connected to the fluid chamber of drive bubble device 108. In such a configuration, DBD 102 can drive a signal or stimulus (e.g. current or voltage) into the DBD sensing component in order to resistively detect response signals (e.g. response voltages) of the formation and dissipation of the bubble in a drive bubble device. If the fluid chamber is empty, the remaining air has a high impedance, meaning the detected voltage response would be high. If the fluid chamber had fluid, the detected voltage response would be low because the fluid at a completely liquid state has a low impedance. If a steam bubble is forming in the fluid chamber, while a current is driven into the DBD sensing component, the detected voltage response would be higher than if the fluid in the fluid chamber were fully liquid. As the heating source gets hotter and more fluid vapors are generated, the voltage response increases because the impedance of the fluid increases. The detected voltage response would climax when the fluid from the fluid chamber is ejected from the nozzle. After which, the bubble dissipates and more fluid is introduced into the fluid chamber from reservoir.

In some examples, DBD 102 can drive the current (to the DBD sensing component) at precise times in order to detect one or more voltage responses, during the formation and dissipation of a bubble in the fluid chamber. In other examples, DBD 102 can drive a voltage to the DBD sensing component and monitor the charge transfer or voltage decay rate, during the formation and dissipation of a bubble in the fluid chamber 202.

Fluid ejection system 100 can determine the state of operability of the components of the drive bubble device, based on the assessments. In some examples, the data of the detected signal response(s) can be compared with a DBD signal response curve. In some examples, the signal response(s) are voltage responses. In other examples, the signal response(s) are the charge transfer or voltage decay rate. Based on the comparison, fluid ejection system 100 can determine the state of operability of the drive bubble device being DBD assessed (e.g. whether the components of the drive bubble device are working properly).

For example, controller 104 can determine the state of operability of drive bubble device(s) 108, based on data on DBD characteristics 110 transmitted from DBD 102. In some examples, data of DBD characteristics includes, the data of signal responses transmitted from DBD 102. Furthermore, controller 104 can compare data of signal responses to a DBD signal response curve. In some examples, the DBD signal response curve can include a signal response curve of a full functioning drive bubble device. If the data of signal responses is similar to the signal response curve of the full functioning drive bubble device, then controller 104 can determine that the DBD assessed drive bubble device 108 is working properly. On the other hand, if the data of signal responses and the signal response curve of the full functioning drive bubble device are not similar, then controller 104 can determine that the DBD assessed drive bubble device 108 is not working properly. In yet other examples, controller 104 can compare the data of signal responses to a signal response curve of a drive bubble device not working properly. If the data of signal responses and the signal response curve of the drive bubble device not working properly are similar, then controller 104 can determine that the DBD assessed drive bubble device 108 is not working properly.

In some examples, fluid ejection die system 100 can be a printer system. FIG. 1B illustrates an example printer system to evaluate a drive bubble device. As illustrated in FIG. 1B, printer system 150 can include modules/components similar to fluid ejection system 100. For example, DBD 154 can be configured to include protector 164. Protector 164 can protect DBD 154 from a short 168, from a fluid ejector 166 that has failed (e.g. from a manufacturing defect, or general usage wear and tear). In some examples, the circuitry of protector 164 can be added to circuit path 332 between a DBD sensing component and DBD 154. In some examples, DBD 154 may include sensor control logic and the sensor control logic may include DBD circuitry. In such examples, the DBD circuitry can include control components or circuitry. As such, protector 164 can protect the control components or circuitry of DBD 154.

In other examples, as illustrated in FIG. 1B, printer system 150 can include controller 152 and fluid ejection die 156. Controller 152 can be configured to implement processes and other logic to manage operations of fluid ejection die 156. For example, controller 152 can transmit instructions 162 to fluid ejection die 156 to modulate or vary the fire pulse length of drive bubble device 158. Additionally, controller 152 can transmit instructions 162 to DBD 154 to monitor the resulting signal responses and transmit data related to those signal responses back to controller 152. In some examples, controller 152 can evaluate the health and functionality of fluid ejection die 156 by controller 152 making assessments on drive bubble device(s) 158. Furthermore, while controller 152 is making assessments on drive bubble device(s) 158, controller 152 can instruct fluid ejection die 156 to concurrently implement servicing or pumping of other drive bubble device(s) 158.

Figure 2:
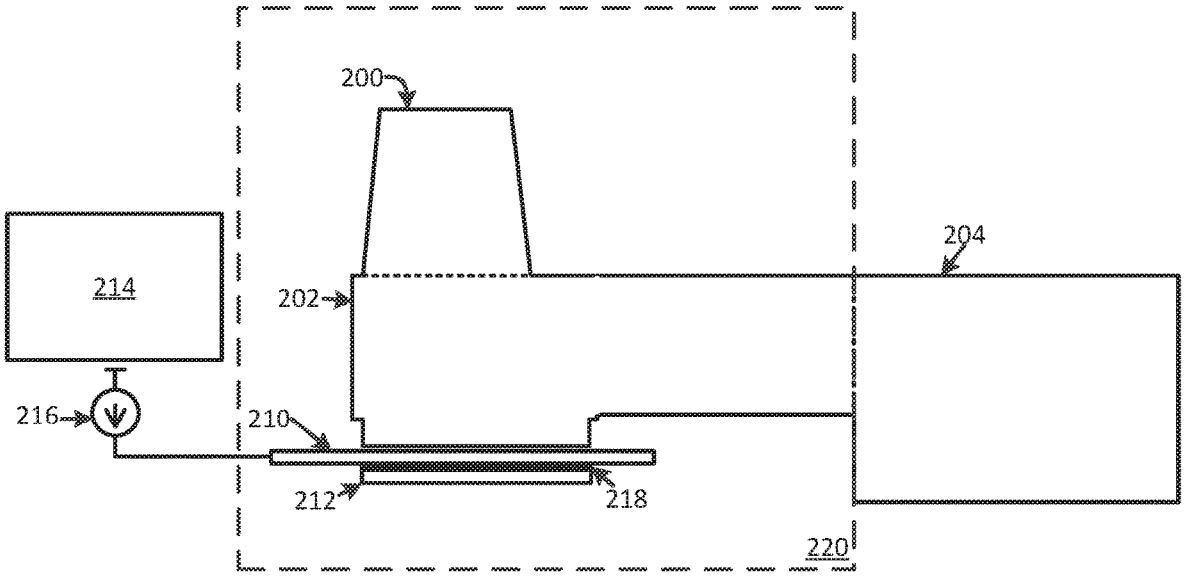
FIG. 2 illustrates an example cross-sectional view of an example drive bubble device including a nozzle, a nozzle sensor, and nozzle sensor control logic.

FIG. 2 illustrates a cross-sectional view of an example drive bubble device including a nozzle, a nozzle sensor, and nozzle sensor control logic. As illustrated in FIG. 2, drive bubble device 220 includes nozzle 200, ejection chamber 202, and fluid ejector 212. In some examples, as illustrated in FIG. 2, fluid ejector 212 may be disposed proximate to ejection chamber 202.

Drive bubble device 220 can also include a DBD sensing component 210 operatively coupled to and located below fluid chamber 202. DBD sensing component can be a conductive plate. In some examples DBD sensing component 210 is a tantalum plate. As illustrated in FIG. 2, DBD sensing component 210 can be isolated from fluid ejector 212 by insulating layer 218.

Figure 1B:
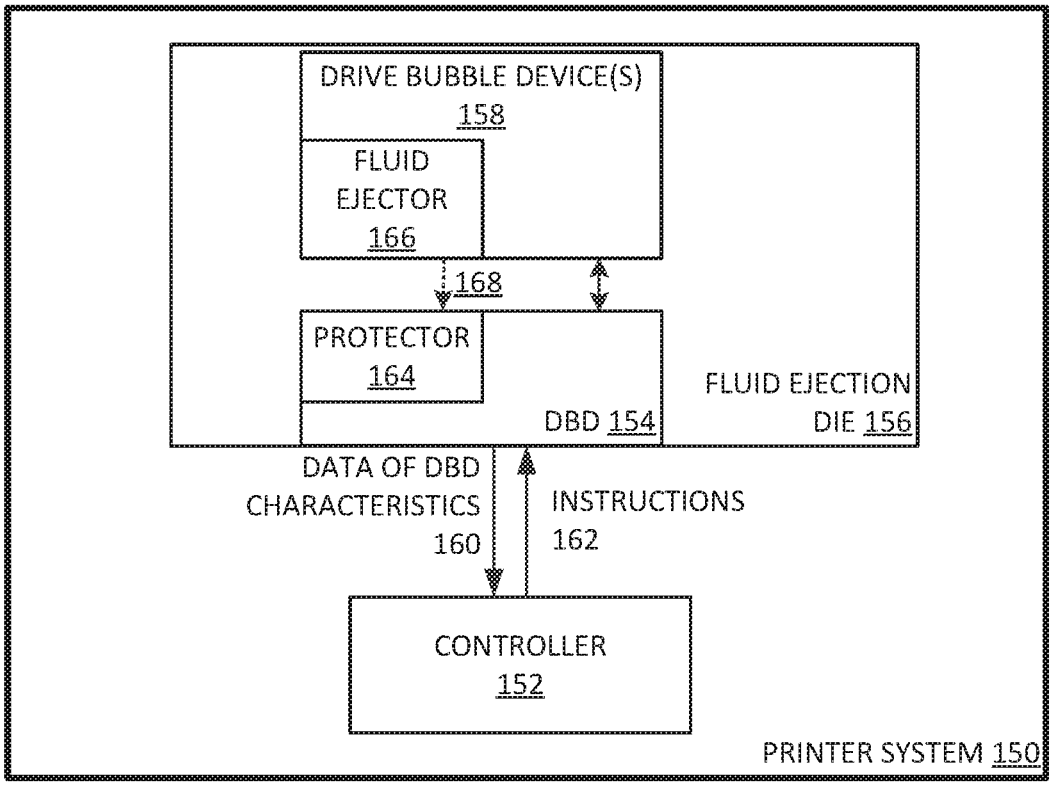
FIG. 1B illustrates an example printer system to evaluate a drive bubble device.

In some examples, a fluid ejection die, such as the example of FIG. 1A, may eject drops of fluid from ejection chamber 202 through a nozzle orifice or bore of the nozzle 200 by fluid ejector 212. Examples of fluid ejector 212 include a thermal resistor based actuator, a piezo-electric membrane based actuator, an electrostatic membrane actuator, magnetostrictive drive actuator, and/or other such devices.

In examples in which fluid ejector 212 may comprise a thermal resistor based actuator, a controller can instruct the fluid ejection die to drive a signal (e.g. power from a power source or current from the power source) to electrically actuate fluid ejector 212. In such examples, the electrical actuation of fluid ejector 212 can cause formation of a vapor bubble in fluid proximate to fluid ejector 212 (e.g. ejection chamber 202). As the vapor bubble expands, a drop of fluid may be displaced in ejection chamber 202 and expelled/ejected/fired through the orifice of nozzle 200. In this example, after ejection of a fluid drop, electrical actuation of fluid ejector 212 may cease, such that the bubble collapses. Collapse of the bubble may draw fluid from fluid reservoir 204 into ejection chamber 202. In this way, in some examples, a controller (e.g. controller 104) can control the formation of bubbles in fluid chamber 202 by time (e.g. longer signal causes hotter resistor response) or by signal magnitude or characteristic (e.g. greater current on resistor to generate more heat).

In examples in which the fluid ejector 212 includes a piezoelectric membrane, a controller can instruct the fluid ejection die to drive a signal (e.g. power from a power source or current from the power source) to electrically actuate fluid ejector 212. In such examples, the electrical actuation of fluid ejector 212 can cause deformation of the piezoelectric membrane. As a result, a drop of fluid may be ejected out of the orifice of nozzle 200 due to the deformation of the piezoelectric membrane. Returning of the piezoelectric membrane to a non-actuated state may draw additional fluid from fluid reservoir 204 into ejection chamber 202.

Examples described herein may further comprise a nozzle sensor or DBD sensing component 210 disposed proximate ejection chamber 202. DBD sensing component 210 may sense and/or measure characteristics associated with the nozzle 200 and/or fluid therein. For example, the nozzle sensor 210 may be used to sense an impedance corresponding to the ejection chamber 202. In such examples, the nozzle sensor 210 may include a first and second sensing plates. In some examples DBD sensing component 210 is a tantalum plate. As illustrated in FIG. 2, DBD sensing device 210 can be isolated from fluid ejector 212 by insulating layer 218. Based on the material disposed between the first and second sensing plates, an impedance may vary. For example, if a vapor bubble is formed proximate to DBD sensing component 210 (e.g. in fluid chamber 202), the impedance may differ as compared to when fluid is disposed proximate the nozzle sensor 210 (e.g. in fluid chamber 202). Accordingly, formation of a vapor bubble, and a subsequent collapse of a vapor bubble may be detected and/or monitored by sensing an impedance with the DBD sensing component 210.

A fluid ejection system can make assessments of drive bubble device 220 and determine a state of operability of the components of drive bubble device 220 (e.g. whether the components of drive bubble device 220 are working properly). For example, as illustrated in FIG. 2, nozzle sensor control logic 214 (including current source 216) can be operatively connected to DBD sensing component 210 to monitor characteristics of the drive bubble device, during the formation and dissipation of the a bubble in fluid chamber 202. For instance, some examples, nozzle sensor control logic 214 can be operatively connected to DBD sensing component 210 to electrically monitor the impedance of the fluid in fluid chamber 202, during the formation and dissipation of the bubble in fluid chamber 202. Nozzle sensor control logic 214 can drive a current from current source 216 into DBD sensing component 210 to detect a voltage response from fluid chamber 202 during the formation and dissipation of a bubble. In some examples, nozzle sensor control logic 214 can drive the current (to DBD sensing component 210) at precise times in order to detect one or more voltage responses, during the formation and dissipation of a bubble in fluid chamber 202. In other examples, nozzle sensor control logic 214 can drive a voltage to DBD sensing component 210 and monitor the charge transfer or voltage decay rate, during the formation and dissipation of a bubble in fluid chamber 202. Nozzle sensor control logic 214 can transmit data related to the voltage responses to a controller (e.g. controller 104) of the fluid ejection system (e.g. fluid ejection system 100). Similar to the principles described earlier, the controller can then determine the state of operability of drive bubble device 200, based on the received data. In some examples, nozzle sensor control logic 214 can include DBD circuitry.

Figure 3:
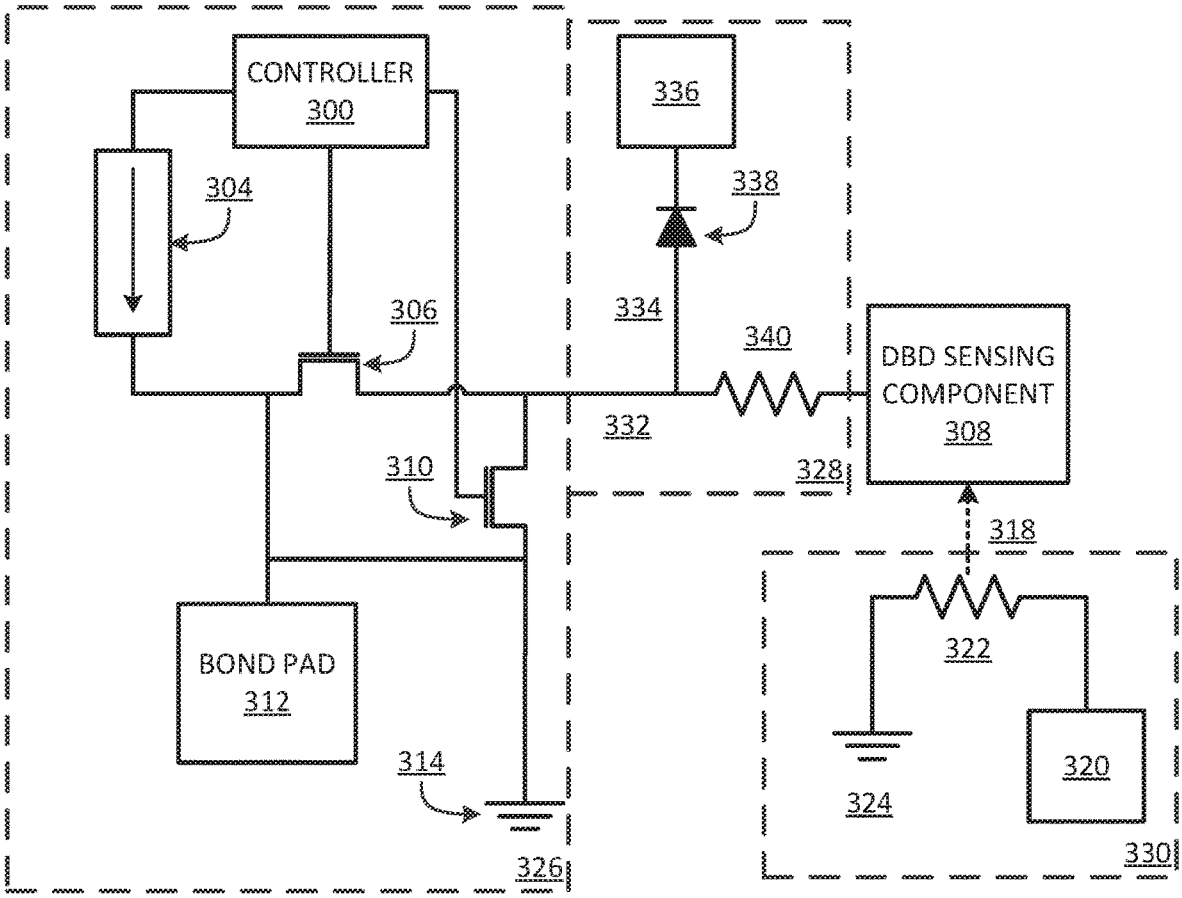
FIG. 3 illustrates an example protection circuit to protect a DBD (drive bubble detect) circuit.

FIG. 3 illustrates an example protection circuit to protect the DBD circuit. As illustrated in FIG. 3, the illustrated circuit includes DBD sensing component 308 (similar to DBD sensing component 210), protector circuit 328 (similar to the circuitry of protector 114), and DBD control circuitry 326. Furthermore, as illustrated in FIG. 3, in some examples, protector circuit 328 is included in circuit path 332 between DBD sensing component 308 and DBD control circuitry 326.

DBD control circuitry 326 can include switches (e.g., FET or MOSFET) 306 and 310, controller 300, and current source 304. Controller 300 can operatively control the states of switches 306 and 310 (e.g. open or close). Furthermore DBD control circuitry 300 can detect a voltage response from the fluid chamber (e.g. fluid chamber 202) of the drive bubble device, during the formation and dissipation of a bubble. For example, controller 300 can close switch 306 and open switch 310 in order to drive a current from current source 304 into DBD sensing component 308. Under such an example configuration, controller 300 can detect the voltage response of the fluid chamber (e.g. fluid chamber 202) of a drive bubble device during the formation and dissipation of a bubble. In some examples, controller 300 can detect the voltage response of the fluid chamber of a drive bubble device through bond pad 312.

Protector circuit 328 can protect damaging effects stemming from a failed fluid ejector 330. In some examples, as illustrated in FIG. 3, fluid ejector 330 can include a heating source. The heating source can include a thermal resistor (e.g. a TIJ resistor) operatively coupled to a high voltage source. If a short occurs between DBD sensing component 308 (e.g. due to TIJ resistor failure), DBD control circuit 326 can be exposed to high current/voltage 318 from fluid ejector 330. Protector circuit 328 can protect DBD control circuit 326 from high current/voltage 318 from fluid ejector 330.

In some examples, protector 114 can include circuitry components that controls the maximum voltage exposed to the control circuitry of DBD 102. This can be especially helpful for low voltage circuits. For example, as illustrated in FIG. 3, protector circuit 328 includes diode 338 and diode supply 336. Diode supply 336 can include a low voltage supply. In some examples, protector circuit 328 can include shunt path 334 extending from circuit path 332 between DBD sensing component 308 and DBD control circuit 326. Furthermore, shunt path 334 includes diode 338 operatively connected to diode supply 336. In some examples, the cathode of diode 338 is connected to low voltage supply 336, while the anode of diode 338 is connected to circuit path 332 between DBD sensing component 308 and DBD control circuit 326. In some examples, diode 338 can be a diode device. In other examples, diode 338 can be a transistor (e.g. JFET or MOSFET).

The diode 338 and diode supply 336 combination can control the maximum voltage that can be exposed to DBD control circuitry 326 from a failed fluid ejector 330. For example, assume high voltage source 320 is a 30 volt voltage source and diode supply 336 is a 5.9 volt voltage supply. In the event of a short from heater resistor 322, the fluid ejector 330 can attempt to drive (e.g. by a controller and a set of control components (e.g. a set of FETs) of fluid ejector 330) the 30 volts into DBD sensing component 308, when attempting to create an fluid bubble in the fluid chamber of the drive bubble device. The 30 volts can attempt to travel to DBD control circuit 328. However, with shunt path 334 that includes diode 338 and low voltage supply 336, the current can be shunted off to the low voltage supply and only a fraction of the 30 volts can be exposed to DBD control circuitry 326. In such examples only the voltage that is dropped over the diode (e.g. 0.8 volts) and the voltage from diode supply 336 (e.g. 5.9 volts) can be exposed to DBD control circuit 326 (e.g. 6.7 volts).

In some examples, protector 114 can include circuitry components that can limit the amount of current that is exposed to the DBD control circuitry of DBD 102. For example, as illustrated in FIG. 3, protector circuit 328 includes protector impedance element 340 that can be added to circuit path 332 between DBD sensing component 308 and DBD control circuit 328. In some examples, as illustrated in FIG. 3, protector impedance element 340 can be added to circuit path 332 between DBD sensing component 308 and shunt path 334 extending from circuit path 332. Protector impedance element 340 can limit the amount of current that is exposed to DBD control circuitry 326, when a short occurs between fluid ejector 330 and DBD sensing component 308. For example, continuing from the example described earlier, if the total exposed voltage to DBD control circuit 326 is 6.7 volts and protector impedance element 340 is a 230 ohm resistor, then resistor 310 is exposed to 23 volts and resulting in 100 mA being shunted safely to diode 338.

In some examples, protector impedance element 340 can be a resistor. In such examples, the larger the resistance of the resistor of protector impedance element 340 the smaller the exposed current can be for DBD control circuit 326. Furthermore, the larger the resistance of the resistor, the longer it takes for the voltage from fluid ejector 330 and exposed to diode 338 to rise. Meaning, diode 338 has more time to activate.

In some examples the resistance of protector impedance element 340 is based on the resistance of the fluid in the drive bubble device as to not degrade the current driven from the DBD circuit during assessment. Meaning protector impedance element 340 can be large enough to limit the rise time of a shorting event, while also limiting the current from fluid ejector 330 below a level that can be handled by diode 338. In other examples protector impedance element 340 can be configured to act as a fuse. Meaning protector impedance element 340 can be blown, at some current threshold, if the current from fluid ejector 330 gets high enough in the event fluid ejector 330 shorts. Under such examples, DBD control circuit 326 can be completely isolated from the failed fluid ejector 330. Meaning in such examples, the repair costs can be reduced since the damage stemming from the failed fluid ejector 330 has been contained.

Although specific examples have been illustrated and described herein, it will be appreciated by those of ordinary skill in the art that a variety of alternate and/or equivalent implementations may be substituted for the specific examples shown and described without departing from the scope of the present invention. This application is intended to cover any adaptations or variations of the specific examples discussed herein. Therefore, it is intended that this invention be limited only by the claims and the equivalents thereof.

What is claimed is:

1. A fluid ejection die comprising:
- a drive bubble device, the drive bubble device including a fluid ejector;
- a sensor operatively connected to the drive bubble device; and a sensor control logic operatively connected to the sensor, the sensor control logic including:
  - a protective circuitry operatively connected between the sensor and a DBD control circuit, the protective circuitry configured to shunt excess portions of a signal transmitted from the sensor to protect a circuit path to the DBD control circuit.

2. The fluid ejection die of claim 1, wherein the sensor is operatively coupled to the fluid ejector.

3. The fluid ejection die of claim 1, wherein the sensor is resistively coupled to the fluid ejector.

4. The fluid ejection die of claim 1, wherein the sensor is located underneath a fluid chamber of the drive bubble device.

5. The fluid ejection die of claim 1, wherein the fluid ejector includes:
- a heating resistor connected to a power source and ground.

6. The fluid ejection die of claim 1, wherein the protective circuit includes:
- a protective impedance element; and
- a shunt diode connected to a voltage supply input.

7. The fluid ejection die of claim 6, wherein the protective impedance element is a resistor, wherein the resistor is operatively connected between the sensor and the sensor control logic.

8. The fluid ejection die of claim 1, wherein the sensor control logic includes:
- a controller, one or more switches, and a current source, wherein the controller is operatively configured to control an output of the current source.

9. The fluid ejection die of claim 8, wherein the controller is operatively configured to control one or more states of a first switch and a second switch.

10. The fluid ejection die of claim 9, wherein the first switch and the second switch are JFETs.

11. The fluid ejection die of claim 9, wherein the first switch and the second switch are MOSFETs.

12. A fluid ejection system comprising:
- a fluid ejection die, the fluid ejection die including:
  - a drive bubble device, the drive bubble device including a fluid ejector;
  - a sensor operatively connected to the drive bubble device; and
  - a sensor control logic operatively connected to the sensor, the sensor control logic including a protective circuitry operatively connected between the sensor and a DBD control circuit, the protective circuitry configured to shunt excess portions of a signal transmitted from the sensor to protect a circuit path to the DBD control circuit.

13. The fluid ejection system of claim 12, wherein the protective circuitry includes:
- a protective impedance element; and
- a shunt diode connected to a voltage supply input.

14. A printer system comprising:
- a fluid ejection die, the fluid ejection die including:
  - a drive bubble device, the drive bubble device including a fluid ejector;

a sensor operatively connected to the drive bubble device; and a sensor control logic operatively connected to the sensor, the sensor control logic including a protective circuitry operatively connected between the sensor and a DBD control circuit, the protective circuitry configured to shunt excess portions of a signal transmitted from the sensor to protect a circuit path to the DBD control circuit.

15. The printer system of claim 14, wherein the protective circuitry includes:

a protective impedance element; and a shunt diode connected to a voltage supply input.

* * * * *